US012123273B1

(12) United States Patent
Roach et al.

(10) Patent No.: US 12,123,273 B1
(45) Date of Patent: Oct. 22, 2024

(54) WIRELINE RELEASE HEAD

(71) Applicant: Reach Wireline, LLC, Fort Worth, TX (US)

(72) Inventors: John P. Roach, Fort Worth, TX (US); Daniel L. Tollefson, Aledo, TX (US); Chris Payson, Fort Worth, TX (US)

(73) Assignee: Reach Wireline, LLC, Fort Worth, TX (US)

( * ) Notice: Subject to any disclaimer, the term of this patent is extended or adjusted under 35 U.S.C. 154(b) by 162 days.

(21) Appl. No.: 17/658,629

(22) Filed: Apr. 8, 2022

Related U.S. Application Data

(63) Continuation-in-part of application No. 17/228,201, filed on Apr. 12, 2021, now abandoned, which is a continuation of application No. 17/062,925, filed on Oct. 5, 2020, now abandoned.

(60) Provisional application No. 62/911,490, filed on Oct. 7, 2019.

(51) Int. Cl.
*E21B 29/04* (2006.01)
*E21B 17/02* (2006.01)

(52) U.S. Cl.
CPC ..... *E21B 29/04* (2013.01); *E21B 17/028* (2013.01)

(58) Field of Classification Search
CPC ..... E21B 29/02; E21B 29/04; E21B 17/028
See application file for complete search history.

(56) References Cited

U.S. PATENT DOCUMENTS 3,036,522 A 5/1962 Lindsey
3,073,388 A * 1/1963 Chenault ..... E21B 29/02 166/54.5
4,237,972 A * 12/1980 Lanmon, II ..... B23D 15/145 166/54.5
8,899,330 B2 * 12/2014 Misselbrook ..... E21B 29/04 166/54.5
2010/0181072 A1 * 7/2010 Gillan ..... E21B 29/04 166/54.5
2011/0067854 A1 * 3/2011 Love ..... E21B 17/06 166/55.1
2015/0083386 A1 * 3/2015 Wells ..... E21B 29/04 166/54.5
2015/0107824 A1 * 4/2015 Signorelli ..... E21B 41/0085 166/244.1

OTHER PUBLICATIONS

Non-Final Office Action, dated Mar. 28, 2023, 5 pages, issued in U.S. Appl. No. 17/228,201.

* cited by examiner

*Primary Examiner* — Christopher J Sebesta
(74) *Attorney, Agent, or Firm* — AVEK IP, LLC

(57) ABSTRACT

A wireline release head system includes a housing, a cutter box situated within the housing, a fire control switch, and a wireline extending through the cutter box and in electrical communication with a control unit and the fire control switch. The cutter box includes a piston assembly operable to move within a first track and a cutter knife operable to move within a second track. The second track is angled relative to the first track. The fire control switch is in communication with a fire detonator, which is selectively activatable to detonate a power charge. An electrical signal selectively sent through the wireline from the control unit to the fire control switch detonates the power charge, which causes the piston assembly to move within the first track and contact the cutter knife causing the cutter knife to move within the second track, thereby severing the wireline.

13 Claims, 3 Drawing Sheets

WIRELINE RELEASE HEAD

CROSS-REFERENCE TO RELATED APPLICATIONS

This application is a continuation-in-part of U.S. patent application Ser. No. 17/228,201, filed on Apr. 12, 2021, which is pending and which is a continuation of U.S. patent application Ser. No. 17/062,925, filed on Oct. 5, 2020, which is abandoned and which claims priority to U.S. Provisional Patent Application No. 62/911,490 filed on Oct. 7, 2019. The entire contents of each of the above-referenced applications is hereby expressly incorporated herein by reference.

FIELD OF THE INVENTION

The invention relates to cutting a wireline utilized in downhole well operations. More particularly, the invention includes a tool, system, and method for selectively disconnecting by cutting a wireline above the cable connection point.

SUMMARY OF THE INVENTION

The following represents a simplified summary of the disclosure in order to provide a basic understanding of some aspects of the disclosure. This summary is not an extensive overview of the disclosure. It is not intended to identify critical elements of the disclosure or to delineate the scope of the disclosure. Its sole purpose is to present some concepts of the disclosure in a simplified form as a prelude to the more detailed description that is presented elsewhere.

According to one embodiment, a wireline release head system includes a housing, a cutter box situated within the housing, a fire control switch, and a wireline extending through the cutter box and being in electrical communication with a control unit and the fire control switch. The cutter box includes a piston assembly operable to move within a first track, and a cutter knife operable to move within a second track. The second track is angled relative to the first track. The fire control switch is in communication with a fire detonator, and the fire detonator is selectively activatable to detonate a power charge. An electrical signal selectively sent through the wireline from the control unit to the fire control switch detonates the power charge, which causes the piston assembly to move within the first track and contact the cutter knife. The contact with the cutter knife causes the cutter knife to move within the second track, and the movement of the cutter knife within the second track severs the wireline.

In another embodiment, a wireline release head includes a cutter box having a piston assembly operable to move within a first track defined in the cutter box; a cutter knife operable to move within a second track defined in the cutter box; and a wireline receiving area for receiving at least a portion of a wireline. The second track is angled relative to the first track. Activation of movement of the piston assembly within the first track causes the piston assembly to contact the cutter knife, thereby causing the cutter knife to move within the second track. The movement of the cutter knife within the second track severs the wireline.

According to still another embodiment, a method of severing a wireline includes first providing a wireline release head. The wireline release head includes a cutter box comprising a piston assembly operable to move within a first track, and a cutter knife operable to move within a second track; a fire control switch for selectively detonating a power charge; and a wireline extending through the cutter box and being in electrical communication with a control unit and the fire control switch. The method continues by selectively activating the control unit to send an electrical signal through the wireline to the fire control switch. The fire control switch detonates the power charge upon receipt of the electrical signal, which causes the piston assembly to move within the first track and contact the cutter knife. The contact causes the cutter knife to move within the second track, which severs the wireline.

DETAILED DESCRIPTION

Figure 1:
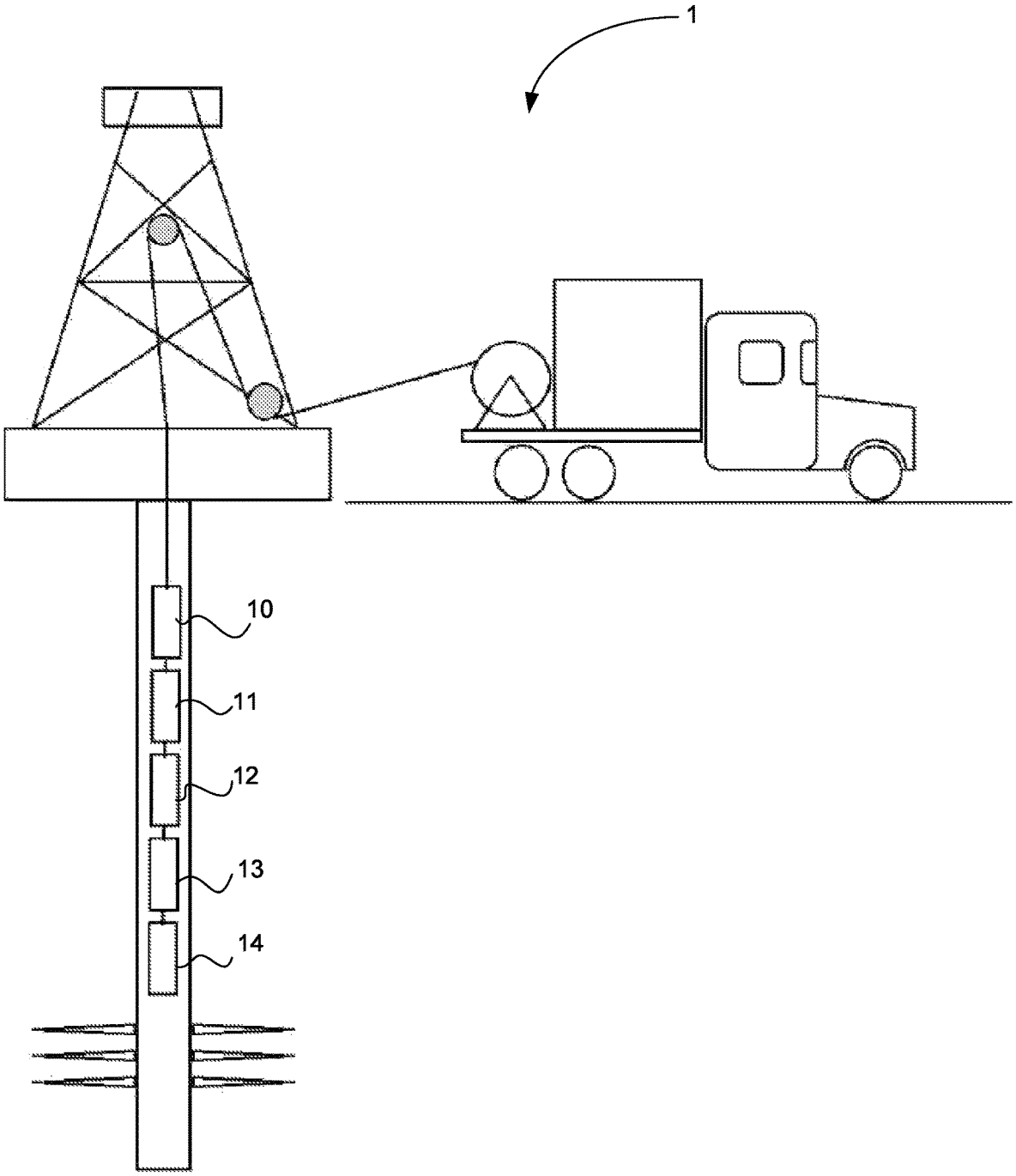
FIG. 1 is a schematic illustration of a wireline tool string according to embodiments of the invention.

Wireline operations are carried out in oil and gas wells to convey tools downhole into the well. A wide variety of downhole tools may be supported on a wireline, including tools to perform logging, perforating, and setting and retrieving operations. The tools typically include a combination of different tubular members threaded together to form a working unit, which is manipulated and controlled from the surface via the wireline. Although tools may be conveyed downhole on a tubing string that can withstand substantially higher extraction forces than a wireline, oftentimes a wireline is preferred because it saves substantial rig time in conveying tools downhole and positioning them within the well.

A cable head, which connects the tools to the wireline, is typically provided with a release mechanism to permit the wireline to be disconnected from the tools in the event the tools become stuck downhole. For normal wireline operations performed in oil and gas wells, it is beneficial to have a primary and contingency means to disconnect the wireline from the tools attached at the end of the wireline if the tool assembly gets stuck to retrieve the wire and more easily retrieve the stuck tool assembly to resume normal activity. Typically, a "disconnect" or "release tool" is included at the top of the assembly. The release tool enables the operator to selectively disconnect from most of the tools, but there may be a portion of the tool assembly still attached to the end of the wireline that will have to be pulled out of the hole with the wireline. The disconnect may not achieve its intended purpose if the stuck point is above the tool assembly.

Therefore, a typical wireline release additionally utilizes a cable head, which serves as an intentionally added mechanical weak point. The cable head is designed to break upon a predetermined pulling force on the wireline, which is less than the breaking strength of the wireline.

Major problems occur if the cable head and tools are stuck in the well and the wireline breaks upon pulling on the wireline with too much tension. Breaking the wireline and dropping the wireline and tools in the well greatly complicates the fishing operation to retrieve the tools. A contingency means for retrieving stuck wireline is to deploy a device, known as a "cutter", to cut the wireline at the deepest possible location. It must be attached to the wireline at surface and blindly fall or be intentionally pumped down to a point where the tool assembly is stuck. Wireline cutters that are used will sever the line when it hits either the top of the stuck tool or could hit an obstruction on path which would likely cut the line higher than desired.

Various other apparatus and methods have been provided for releasing the wireline from the cable head and tools. One common method of releasing the wireline includes the use of a spring set at a particular tension. Once the force on the spring is exceeded, the wireline is released. This release still requires that the amount of load required to release the wireline be predetermined prior to lowering the cable head into the well. If the spring tension is exceeded, there can be a premature release of the cable head.

Another release apparatus relies primarily on shear pins or shear screws. Problems are encountered with shear screws having a low failure point because they are exposed to various cyclical forces that tend to affect their ultimate shear rating. The shear screws are exposed to fluids in the well that, over time, can affect the inherent strength of the shear screws or pins making them susceptible to failure at stresses below their rated failure point. Unexpected release can significantly delay operations, causing additional operating expense. An unexpected release can also result in the loss of downhole tools, and in extreme cases can cause severe damage to the wellbore requiring substantial time and money to repair.

Furthermore, most wireline release tools are designed to be installed somewhere in the middle of the tool string below the cable connection point. This means that the wireline may have to pull a portion of the rope socket still attached to the wireline or full outer diameter (OD) tools like casing collar locators, cable head connector and weight bars out of hole in order to be retrieved. It is very common that the obstruction that is causing the tools and wireline to be stuck is above all the tools at the transition point from wireline OD to tool OD that will cause the wireline to remain stuck.

It is, therefore, desirable to provide a wireline disconnect that ensures the wireline will break where desired and allow for removal of components. As will be described in greater detail below, the invention essentially comprises a selective cut wireline release head that includes a primary device that connects the wireline to the tool string and a device to disconnect the wireline from the tool if the tool has become unintentionally stuck while performing normal operations. The means for connecting the two pieces together may be a set of cups and cones, known as a rope socket cartridge, and may have the ability to transmit electrical current through the entire tool assembly and lock into position so not to swivel in reference to the wireline. A cutting device may be the primary means to release the wireline from the attached tool assembly. The cutting mechanism may be driven with surface controlled incendiary charge that burns within the cable head. When the operation is complete, only the wireline will come out of the hole and the tool string will have to be retrieved with fishing or other tools. At the end of the operation, the pressure from the incendiary will be released automatically prior to retrieving tools.

Referring now to the drawings, and specifically FIG. 1, an exemplary wireline tool string system 1 includes a selective cut wireline release head system 10 according to embodiments of the invention, together with a casing collar logging tool 11, a perforating gun system 12, a frac plug setting tool 13, and a frac plug 14. Additional, or fewer components, may be included within the tool string system 1, as is known to those of skill in the art.

While the system 1, and more particularly the wireline release head system 10, may be generally used in well wireline operations, and specifically hydrocarbon retrieval, the system 10, or specific components of the wireline release head system 10, may be utilized for other well applications such as water retrieval, for example.

Figure 2:
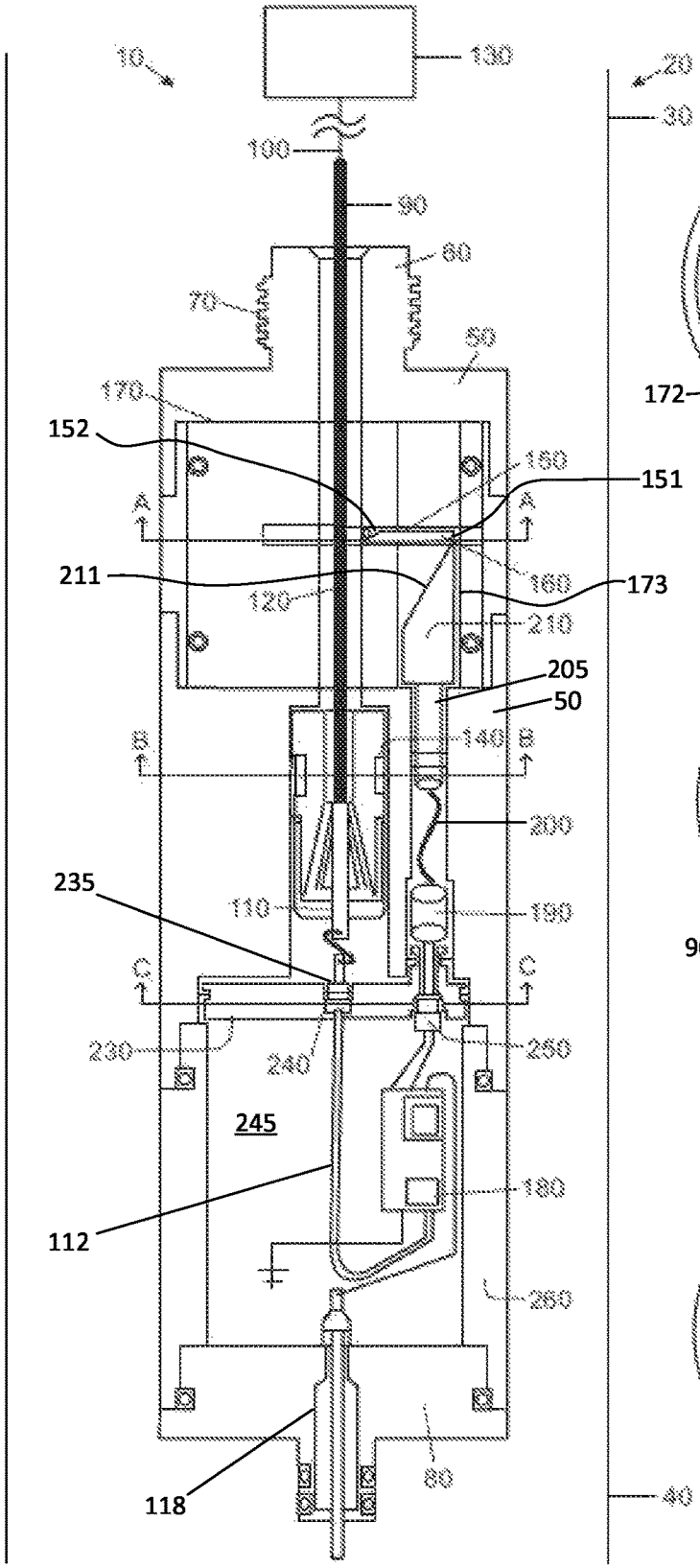
FIG. 2 is a cross section illustration of an embodiment of the invention in a run in hole position.

Moving on to FIG. 2, the wireline release head system 10 is shown within a well 20, which is drilled into a surface 30 and includes a lower position 40 where hydrocarbons enter the well 20. It shall be understood that the system 10 may be used on a horizontal and/or vertical well 20. The system 10 may generally include a housing 50 with a top sub 60 and a bottom sub 80. The top sub 60 may include a fishing profile 70, and weight bars may be attached to the system 10 at the top sub fishing profile 70.

The housing 50 surrounds an electric wireline 90 which may include a top portion 100, a middle portion 120, and a bottom portion 110. The wireline top portion 100 is operably connected to a control unit 130. The wireline bottom portion 110 connects to the housing 50 at a rope socket 140, described in greater detail below.

Figure 2A:
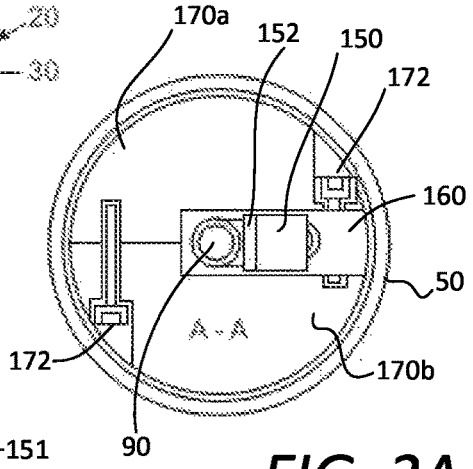
FIG. 2A is a top view of the invention taken along Line A-A in FIG. 2.

Between the wireline top portion 100 and the bottom portion 110, a cutter box 170 surrounds at least a section of the wireline middle portion 120. The cutter box 170 may have a clamshell design as shown in FIG. 2A. Each half 170*a* and 170*b* of the cutter box 170 may have a cutout that, when the halves 170*a* and 170*b* are joined together via fasteners 172, form an opening for receiving the wireline 90. The diameter of the opening for the wireline 90 may be substantially similar to the diameter of the wireline 90 itself, but just slightly larger to allow the wireline 90 to freely move up and down within the cutter box 170. The cutter box 170 may have a threadable attachment portion that allows the cutter box to be threadably attached to the housing 50. Other means of securing the cutter box 170 to or within the housing 50 are also possible and are within the skill of one in the art.

The cutter box 170 includes a first track 173. The track 173 provides a translation area for a piston assembly. The piston assembly may include a piston rod 205 and a piston wedge 210. The piston rod 205 and piston wedge 210 may be separate components, or they may be combined into a single component. Regardless, the piston rod 205 and the piston wedge 210 are activated to move within the track 173 via a power charge 200, described in greater detail below.

The piston rod 205 may be equipped with seals, such as O-rings, that provide an initial seal between the power charge 200 and the piston wedge 210, thus allowing the piston rod 205 to push the piston wedge 210 upon detonation as described below. The seals may be further configured to disengage after a period of time so that pressure is not trapped within the system 10.

The piston wedge 210 has an angled surface 211. The angled surface 211 may be angled from about 0 to about 60 degrees relative to vertical. In embodiments, the angle of the piston wedge 210 is about 5 to about 45 degrees, about 5 to about 30 degrees, or 10 to about 20 degrees. In embodiments, the angle of the piston wedge 210 is about 10 degrees. The angled surface 211 of the piston wedge 210 is configured to engage with a cutter knife 150.

The cutter knife 150 is positioned within a second track 160 defined in the cutter box 170. The track 160 may be generally perpendicular to or at some other desirable angle relative to track 173. To facilitate unimpeded movement of the cutter knife 150, an outside edge 151 of the cutter knife 150 may be angled. The angle of the outside edge 151 of the cutter knife 150 may be determined based on the angle of the angled surface 211 of the piston wedge 210. In other words, the angled surface 211 of the piston wedge 210 may generally correspond to the angle of the cutter knife outside edge 151. Corresponding angles between the piston wedge angled surface 211 and the cutter knife outside edge 151 helps smooth translation of the cutter knife 150 within the track 160, as without corresponding edges, upon detonation, the piston wedge 210 is pushed into the cutter knife 150 which may cause a back end of the cutter knife 150 to be pushed upward within the track 160, rather than the knife 150 simply sliding towards the wireline 90 within the track 160.

An inside edge 152 of the cutter knife 150 is also angled so as to provide a sharp edge for slicing through the wireline 90. It has been found that by reducing the angle of the cutter knife inside edge 152, shear forces between the cutter knife 150 and the wireline 90 are reduced. The angle of the inside edge 152 may be between about 5 and about 30 degrees relative to horizontal. However, the angle of the cutter knife 150 may be any angle that allows the knife 150 to sever the wireline 90 when the knife 150 is activated.

Moving on, the rope socket 140 may be any rope socket 140 now known or later developed, including but not limited to wedge type, spool type, slip type, and clamp type rope sockets. In embodiments, the wireline 90 is secured to the rope socket 140 via a cup and cone bearing that allows the wireline 90 to rotate within the rope socket 140 as is known to those of skill in the art. The rope socket 140 may be packed with grease to reduce friction on the wireline 90.

Figure 2B:
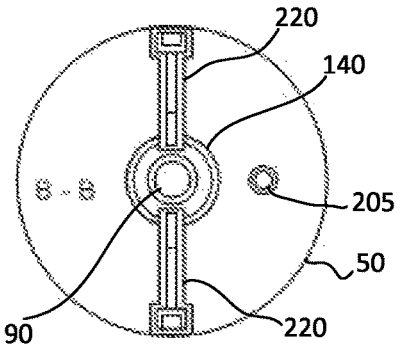
FIG. 2B is a top view of the invention taken along Line B-B in FIG. 2.

The rope socket 140 may be held in place within the housing 50 via one or more lock screws 220, further illustrated in FIG. 2B. The lock screws 220 may prevent the rope socket 140 from turning due to torque on the system 10, and may further prevent the rope socket 140 from moving up and down within the housing 50.

The wireline 90 extends through the rope socket 140 and is operably connected to an electrical feedthrough 112, for example, via a tear drop coupling 235. The tear drop coupling 235 may be seated in a bulkhead 230 such that the electrical feedthrough 112 extends into a lower cavity 245 defined in a bulkhead retainer and switch housing 260. The bulkhead 230 seals off the cavity 245, and a secondary seal 240 may be positioned around the coupling 235, thereby providing pressure isolation between the cavity 245 and the rest of the system 10.

Figure 2C:
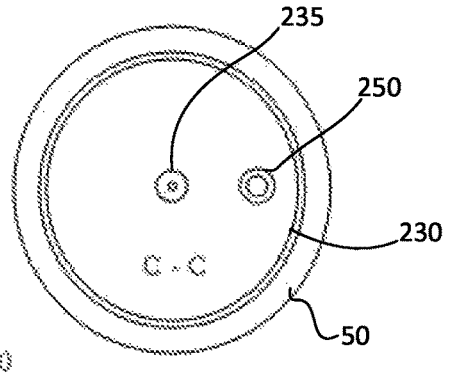
FIG. 2C is a top view of the invention taken along Line C-C in FIG. 2.

The electrical feedthrough 112 is operably connected to a fire control switch 180, which receives a signal from the control unit 130 and subsequently provides electrical signal to the remainder of the system 1 as described below, and controls activation of the cutter tool 150. The fire control switch 180 may preferably, but need not necessarily, be in line with the wireline 90. The fire control switch 180 includes electrical leads that may extend through an opening in the bulkhead 230. Where the electrical leads extend through an opening 250 in the bulkhead 230, a seal may be placed in the opening to maintain the pressure isolation of the cavity 245. FIG. 2C is a top view taken along line C-C in FIG. 2, showing the coupling 235 and the opening 250 in the bulkhead 230. In embodiments, the bulkhead 230 is coupled (e.g., threadably) to an interface member. Like the bulkhead 230, the interface member may be a metal component such that, when the interface member is coupled to the bulkhead 230, a metal-to-metal seal is formed between the interface member and the bulkhead 230. The electrical leads from the fire control switch 180 may extend through the interface member. The interface member may include, for example, O-rings or other sealing mechanisms for further maintaining the pressure isolation of the cavity when the interface member is coupled to the bulkhead 230.

However they leave the cavity 245, the electrical leads are electrically joined to a fire detonator 190, which is generally housed in a void formed within the housing 50. The fire detonator 190 is configured to ignite a power charge 200 within the housing 50. In embodiments, the power charge 200 includes a tube of propellant, such as black powder. The power charge 200 is located beneath the piston rod 205 such that, when the charge 200 is detonated via the fire control switch 180, the piston rod 205 moves the piston wedge 210 toward the cutter knife 150, thereby forcing the cutter knife 150 towards the wireline 90 in order to sever the wireline 90.

The bulkhead retainer and switch housing 260 couples to the bottom sub 80. The bottom sub 80 may in turn include an electrical coupling mechanism 118. The electrical coupling mechanism 118 is in electrical communication with the fire control switch 180, and thus receives signal from the control unit 130 via the fire control switch 180 for providing electrical current to the remainder of the tool assembly below the wireline release head system 10. The electrical coupling mechanism 118 may be any mechanism now known or later developed. In embodiments, the electrical coupling mechanism 118 is a switch carrier, such as that described in U.S. patent application Ser. No. 17/454,777, which is incorporated by reference herein in its entirety.

Moving on, FIGS. 3, 3A, 3B, and 3C generally illustrate the position of the cutter knife 150 and the wireline 90 after detonation of the power charge 200. The control unit 130 selectively sends a signal through the wireline 90 which activates the fire control switch 180 to trigger the fire detonator 190 to detonate the power charge 200. Detonation of the power charge 200 forces movement of the piston rod 205 and piston wedge 210 in the track 173 towards the cutter knife 150, as shown by the arrow.

Figure 3:
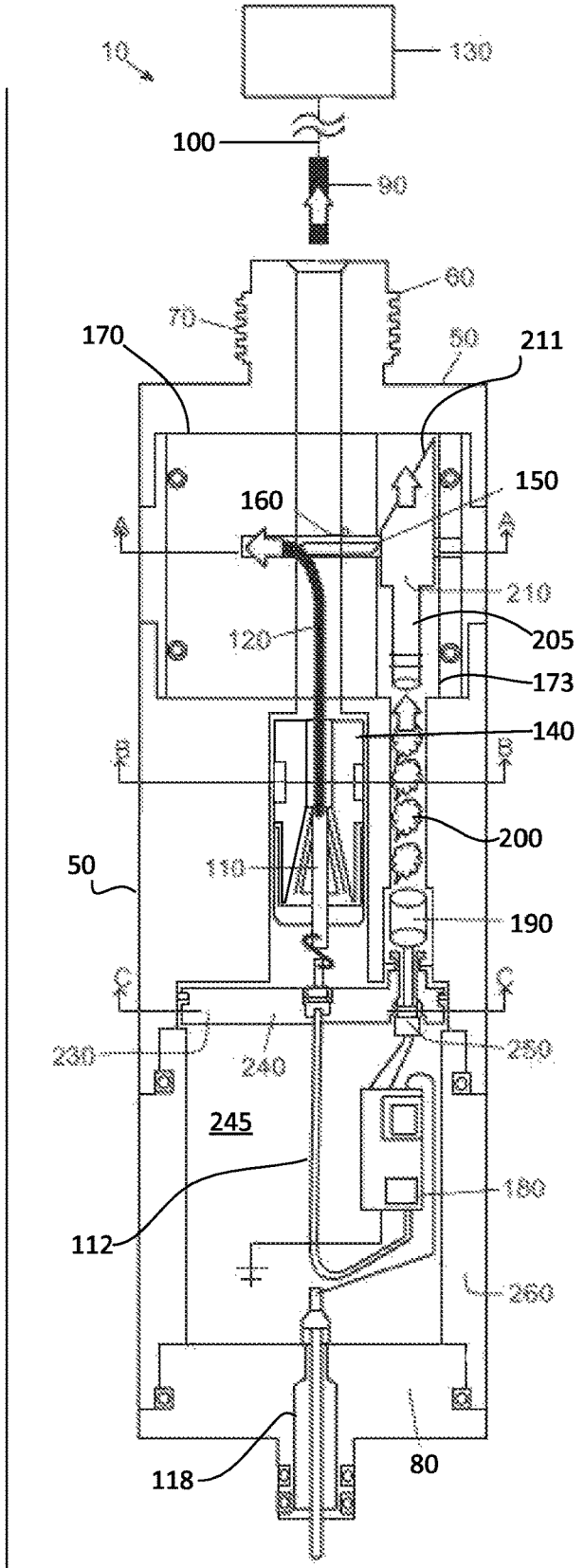
FIG. 3 is a cross section illustration of embodiment of the invention in a released position.
Figure 3A:
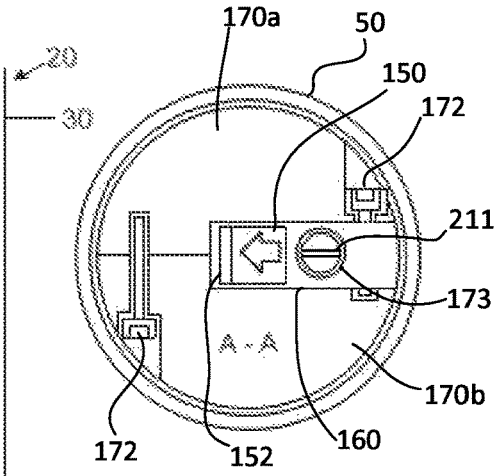
FIG. 3A is a top view of the invention taken along Line A-A in FIG. 3.
Figure 3B:
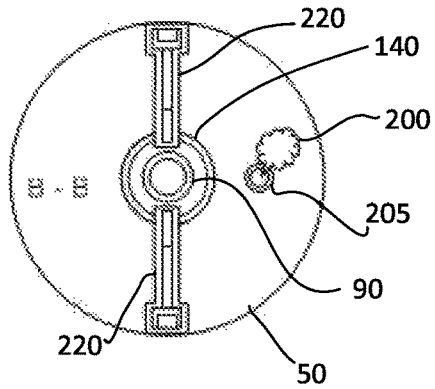
FIG. 3B is a top view of the invention taken along Line B-B in FIG. 3.
Figure 3C:
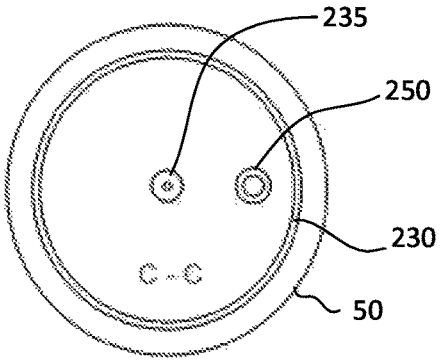
FIG. 3C is a top view of the invention taken along Line C-C in FIG. 3.

The angled surface 211 of the piston wedge 210 contacts the outside edge 151 of the cutter knife 150, forcing the cutter knife 150 towards the center of the cutter box 170, as shown in FIG. 3A. The force of the piston wedge 210 against the cutter knife 150 causes the cutting edge 152 of the cutter knife 150 to sever the wireline 90. The end of the wireline 90 may be pushed into free space within the track 160, as shown by the arrows in FIG. 3. The remaining freed wireline 90 may be subsequently pulled from the well 20 towards the surface 30. Fishing operations for the remainder of the tool string can then be commenced.

It shall be understood that the selective cut wireline release head 10 may be placed anywhere along the wireline 90. If the release head 10 is placed between tools on the wireline 90, the tools above the release head 10 may be retrieved with the remaining wireline 90 when the wireline 90 is severed as described above. Fishing operations may then be commenced to recover tools that remain in the well 20.

Many different arrangements of the various components depicted, as well as components not shown, are possible without departing from the spirit and scope of the disclosure. Embodiments of the invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the disclosure. It will be understood that certain features and subcombinations are of utility and may be employed without reference to other features and subcombinations and are contemplated within the scope of the claims. Not all steps listed in the various figures need to be carried out in the specific order described unless specified.

What is claimed is:

1. A wireline release head system, comprising:

a housing;

a cutter box situated within the housing, the cutter box comprising a piston assembly operable to move within a first track, and a cutter knife operable to move within a second track; wherein the second track is angled relative to the first track;

a fire control switch in communication with a fire detonator, the fire detonator being selectively activatable to detonate a power charge;

a wireline extending through the cutter box and being in electrical communication with a control unit and the fire control switch;

a bulkhead; and an interface member coupled to the bulkhead;

wherein:

the fire control switch is positioned within a cavity in the housing;

the bulkhead is positioned atop the cavity to isolate pressure within the cavity;

electrical leads from the fire control switch pass through the interface member and are electrically connected to a fire detonator, the fire detonator causing detonation of the power charge; and the detonation of the power charge causes the piston assembly to move within the first track and contact the cutter knife, thereby causing the cutter knife to move within the second track, wherein movement of the cutter knife within the second track severs the wireline.

2. The wireline release head system of claim 1, wherein the cutter box has a clamshell design comprising a first portion and a second portion, the first and second portions together defining a wireline receiving area; wherein a diameter of the wireline receiving area is substantially similar to a diameter of the wireline.

3. The wireline release head system of claim 1, wherein the piston assembly comprises a piston rod and a piston wedge.

4. The wireline release head system of claim 3, wherein the piston wedge comprises an angled surface.

5. The wireline release head system of claim 1, wherein the piston assembly comprises an angled surface.

6. The wireline release head system of claim 5, wherein:

the cutter knife comprises an angled outside edge; and an angle of the angled outside edge of the cutter knife generally corresponds to an angle of the piston assembly angled surface.

7. The wireline release head system of claim 6, wherein the angle of the cutter knife angled outside edge and the piston assembly angled surface is about 5 to about 30 degrees.

8. The wireline release head system of claim 1, wherein a metal-to-metal seal is created between the interface member and the bulkhead to maintain pressure isolation of the cavity.

9. The wireline release head system of claim 8, further comprising a rope socket, wherein the rope socket receives an end of the wireline and is electrically coupled to an electrical feedthrough, the electrical feedthrough extending into the cavity and being electrically coupled to the fire control switch.

10. The wireline release head system of claim 9, wherein the electrical feedthrough is coupled to the rope socket via a tear drop coupling.

11. The wireline release head system of claim 1, further comprising a rope socket, wherein the rope socket receives an end of the wireline and is electrically coupled to an electrical feedthrough, the electrical feedthrough being electrically coupled to the fire control switch.

12. The wireline release head system of claim 1, wherein the fire control switch is in electrical communication with an electrical coupling mechanism, the electrical coupling mechanism being configured to provide electrical current from the control unit to a tool coupled to the wireline release head.

13. The wireline release head system of claim 1, wherein the second track is generally perpendicular to the first track.

* * * * *